US011970805B2

(12) United States Patent
Selvarajan

(10) Patent No.: US 11,970,805 B2
(45) Date of Patent: Apr. 30, 2024

(54) SYSTEM AND DEVICE FOR DYEING FABRICS ON-DEMAND

(71) Applicant: Balamurugan Selvarajan, Bangalore (IN)

(72) Inventor: Balamurugan Selvarajan, Bangalore (IN)

(73) Assignee: v Personalize, Inc., Houston, TX (US)

( * ) Notice: Subject to any disclaimer, the term of this patent is extended or adjusted under 35 U.S.C. 154(b) by 393 days.

(21) Appl. No.: 17/387,060

(22) Filed: Jul. 28, 2021

(65) Prior Publication Data

US 2023/0030544 A1 Feb. 2, 2023

(51) Int. Cl.
*D06B 1/02* (2006.01)
*D06P 5/30* (2006.01)

(52) U.S. Cl.
CPC . *D06B 1/02* (2013.01); *D06P 5/30* (2013.01)

(58) Field of Classification Search
CPC ..... D06F 1/02; D06B 1/02
See application file for complete search history.

(56) References Cited

U.S. PATENT DOCUMENTS

2014/0277751 A1* 9/2014 Fulmer ..... D06M 13/402 700/275

* cited by examiner

*Primary Examiner* — Jason Y Ko

(57) ABSTRACT

The embodiments herein discloses a system for dyeing fabrics on-demand, comprising a flatbed mechanism for loading a substrate for dyeing; an ink feeder mechanism, consisting of at least Cyan, Magenta, Yellow and Black (C, M, Y, K) colors and a color combiner mechanism or color mixer to combine the inks and create a composite ink; at least two nozzle heads to deposit the composite ink on both sides of a substrate; an operator console; and a reset mechanism. The nozzle is configured to move across the entire width of a substrate from one side to the other, while the substrate rolls to aid dyeing. The nozzle dyes a single color at any given time.

18 Claims, 2 Drawing Sheets

SYSTEM AND DEVICE FOR DYEING FABRICS ON-DEMAND

BACKGROUND

Technical Field

The embodiments herein generally relate to the field of textile dyeing and printing. The embodiments herein are particularly related to a system and method for dyeing colors on fabrics in an environmentally friendly manner. The embodiments herein are more particularly related to a system and method for dyeing fabrics on demand

Description of the Related Art

Dyeing fabrics is a well-known technique used for centuries. Dyeing is the application of dyes or pigments on textile materials such as fibers, yarns, and fabrics with the goal of achieving color with desired color fastness. Dyeing is normally done in a special solution containing dyes and particular chemical material. Dye molecules are fixed to the fiber by absorption, diffusion, or bonding with temperature and time being key controlling factors.

Typically, dyeing is done by "Yarn dyeing", where the yarns are dyed first before the fabric manufacturing stage. Dyeing is also done by "Garment dyeing", where the garments are constructed of undyed fabrics and then the whole garment is dyed by soaking in a color pigment.

Textile printing is the process of applying color to fabric in definite patterns or designs. In properly printed fabrics the color is bonded with the fiber, so as to resist washing and friction. Textile printing is different to dyeing, as in dyeing properly the whole fabric is uniformly covered with one color, whereas in printing one or more colors are applied to it in certain parts only, and in sharply defined patterns. The most common method of printing is "Direct printing" or "Textile Printing", in which colorants containing dyes, thickeners, and the mordants or substances necessary for fixing the color on the cloth are printed in the desired pattern.

Dyeing and printing are different applications; in printing, color is applied to a localized area with desired patterns. In dyeing, it is applied to the entire textile. The quality of fabric from printing is generally not considered to be at the same level as dyed.

The quality of fabric from printing is generally considered to be of lower quality than dyed fabrics. All premium apparel and accessory are made from dyed fabric and not from printed fabric. For example, if a printed fabric is stretched, the original fabric color (typically white) will show through. For this reason, a printed suit, for example, can never be made to the same quality standards of a suit made from dyed fabric.

It is a well-known fact that the fashion sector was responsible for 2.1 billion metric tons of greenhouse-gas (GHG) emissions in 2018, about 4 percent of the global total—that's more than France, Germany and the UK combined that year—making it the second largest polluter in the world. The fashion industry is also the second largest consumer of the world's water supply, accounting for 20 percent of industrial water pollution globally and 79 billion cubic meters of water in 2017 alone. Using processes and machines that waste less water and materials is an obvious way for the fashion industry to significantly reduce its impact on the environment.

Unlike a digital printer, the dye-print machine, described herein, uses a pre-mixer to create a composite color, which is then deposited on to a substrate. The dye-print machine can only use a single color at any given time. So, it cannot print a photo or multi-color pattern like a digital printer. Typical quality of print in digital printing is defined by dots per inch (dpi), the number of dots the printer can print in a given inch.

In a traditional digital printer, fluid surface tension naturally pulls a stream into droplets. Optimal drop sizes of 0.004 inch require an inkjet nozzle size of about 0.003 inches. Fluids with surface tension may be water based, wax or oil based and even melted metal alloys. Most drops can be electrically charged. There are two main technologies in use in contemporary inkjet printers: continuous (CIJ) and drop-on-demand (DOD). Continuous inkjet means the flow is pressurized and in a continuous stream. Drop-on-demand means the fluid is expelled from the jet nozzle one drop at a time.

In a typical digital printer, there is no mixing of colors. It involves printing lots of tiny single-color dots, one next to the other, the quality of print being determined by the dpi (dots per inch). In a typical direct-to-garment or textile printing, colors are never mixed, rather it prints millions of dots of cyan, magenta, yellow or black color in a predetermined size and frequency: it is our eyes and brains that process this information to reproduce color! It is important to note that a digital printer deposits one of C or M or Y or K as the print dots. It is our eyes that create the illusion of color.

One of the key drawbacks of digital printing, especially for fabric printing is called "grin". This is the tendency of a printed fabric to show the underlying color (typically, white) when it is stretched.

Hence there is a need for a system and method for dyeing fabrics on-demand. Further there is a need for a special type of printer device that is able to dye-print only one color at any given time (unlike a typical digital printer which prints millions of colors as tiny dots). Still further there is a need for a special type of printer device that is able to deposit a dye on both sides of the substrate, with two synchronized nozzles and to stretch the substrate during dye-print. Yet further there is a need for a dye print device that mixes the CMYK colors in the right proportion, just before it reaches the nozzle/head for printing, in real-time.

Objectives of the Embodiments Herein

A primary objective of the embodiments herein is to develop a system and method for dyeing fabrics on-demand.

Another objective of the embodiments herein is to develop a special type of print device that is able to only dye/print one-color at any given time.

Yet another objective of the embodiments herein is to develop a dye-print device that is capable of depositing a dye on both sides of the substrate, with two synchronized nozzles and stretching the substrate during dye-print.

Yet another objective of the embodiments herein is to develop a dye-print device in which a substrate, such as a knit, woven fabric or any material that absorbs the type of dye being deposited, moves on a flatbed mechanism, while a nozzle deposits the dye on the substrate.

Yet another objective of the embodiments herein is to develop a dye-print device in which the nozzle is configured to move the entire distance of the flatbed in one or both directions.

Yet another objective of the embodiments herein is to develop a dye-print device in which, a movement of the nozzle is controlled by a computing device such that the nozzle is moved in one or both directions over the flatbed.

Yet another objective of the embodiments herein is to develop a dye-print device in which the nozzle is fixed and covers the entire width of the flatbed and deposits the dye over a moving substrate.

Yet another objective of the embodiments herein is to develop a simple and cost-effectivedye-print device since dyeing is for a single color and does not require precision.

Yet another objective of the embodiments herein is to develop a dye-print device in which the nozzle is nothing more than a perforated tube that allows the ink to seep through to the moving substrate below.

Yet another objective of the embodiments herein is to develop a dye-print device in which, the nozzle is configured to move and be turned on/off as it deposits a dye thereby enabling the device to dye shapes on the substrate (e.g: a square, circle or sleeve pattern).

Yet another objective of the embodiments herein is to develop a dye-print device comprising a flatbed for laying the substrate, a roller mechanism for the undyed fabric roll to be loaded, a moving head assembly for the nozzle to move in at least one direction through the entire length of the flatbed, a ink feeder mechanism, ink containers and an operator console.

Yet another objective of the embodiments herein is to develop a dye-print device in which two print heads are used to dye the fabric. One head operates on top and one on the bottom of the substrate, both dyeing the same color synchronously.

Yet another objective of the embodiments herein is to develop a dye-print device in which, the heads are operated asynchronously, and a micro controller device is provided to calibrate the dye for the two heads by calculating a linear distance between the two heads and the time taken for the fabric roll to travel the distance between the two.

Yet another objective of the embodiments herein is to develop a dye-print device in which, the composite color is dynamically mixed as a process color from a ink containers, that at least includes C, M, Y, K (Cyan, Magenta, Yellow & Black), and wherein the inks for C, M, Y, K (Cyan, Magenta, Yellow and Black) are mixed before being deposited through the nozzle.

Yet another objective of the embodiments herein is to develop a dye-print device in which, the color mixer is an analog device, and a tap is used to control the flow of ink and once configured the color mixer is used to mix only a given color until the color mixer is re-configured manually.

Yet another objective of the embodiments herein is to develop a dye-print device in which, a single color is used for dyeing and a composite color from CMYK is pre-mixed in the right proportion, to create a composite ink, that is then deposited to the substrate.

Yet another objective of the embodiments herein is to develop a dye-print device used to dye yarn, before it is woven or knitted.

Yet another objective of the embodiments herein is to develop a dye-print device which is instructed to switch color using a "reset" mechanism to change colors.

Yet another objective of the embodiments herein is to develop a dye-print device in which, the reset mechanism instructs the color mixer to mix a different set of CMYK, instructs the nozzle to dye the substrate till the old color is fully used up, and dyes a swatch with the new color till saturation is reached and then start the new dye job.

Yet another objective of the embodiments herein is to develop a dye-print device in which, the nozzle sizes are much larger, suite for a single color print, so that water based dyes are used.

Yet another objective of the embodiments herein is to develop a dye-print device which is easily operated, less toxic and more environmentally friendly.

Yet another objective of the embodiments herein is to develop a dye-print device, which is manufactured at an economical cost, because the device only uses one color at a time.

Yet another objective of the embodiments herein is to develop a dye-print device in which, an operator console is provided for choosing a color for dyeing and to input a shape such as rectangle, sleeve shape, etc.

Yet another objective of the embodiments herein is to develop a dye-print device in which, a computing device is attached to the console to control the nozzle to turn it on/off and the moving head assembly to move and dye the fabric.

Yet another objective of the embodiments herein is to develop a dye-print device in which, the roller rotates the fabric roll in a smooth motion so as to enable the nozzle to dye different parts of the fabric.

Yet another objective of the embodiments herein is to develop a dye-print device which mixes the CMYK colors in the right proportion, just before it reaches the nozzle/head for printing, in real-time.

These and other objects and advantages of the embodiments herein will become readily apparent from the following detailed description taken in conjunction with the accompanying drawings.

SUMMARY

This summary is provided to provide a brief introduction of concepts related to the embodiments of the present invention. The concepts are further described below in the detailed description. This summary is not intended to identify key features or essential features of the claimed subject matter, nor is it intended to be used to limit the scope of the claimed subject matter.

The various embodiments of the invention provide a novel device and technique for dyeing localized areas of a fabric, in small quantities and when needed (on-demand) This technique is referred herein using the moniker "Dye Print". According to an embodiment herein, the device is a special type of printer that only deposits one-color at a time (unlike a typical digital printer which can print millions of color, as tiny dots). Unlike a digital printer, the dye-print machine disclosed in the embodiments herein uses a pre-mixer to create a composite color, which is then deposited on to a substrate. The dye-print machine deposits only a single color at any given time.

According to an embodiment herein, a system for dyeing fabrics on-demand, comprises a flatbed mechanism for loading a substrate for dyeing; an ink feeder mechanism, consisting of at least Cyan, Magenta, Yellow and Black (C, M, Y, K) colors and a color combiner mechanism or color mixer to combine the inks and create a composite ink; at least two nozzle heads to deposit the composite ink on both sides of a substrate; an operator console; and a reset mechanism.

According to an embodiment herein, the at least two nozzle heads are configured to dye the substrate through a synchronous ink deposition technique.

According to an embodiment herein, the at least two nozzle heads are configured to dye the substrate through an asynchronous ink deposition technique.

According to an embodiment herein, the at least two nozzle heads are mounted on a moving head assembly to traverse the entire width of the substrate and the nozzle is further turned on or off.

According to an embodiment herein, the at least two nozzle heads are configured to move through the entire distance of the flatbed in both directions.

According to an embodiment herein, the at least two nozzle heads are controlled by a computing device such that both the nozzles are moved in one or both directions over the flatbed.

According to an embodiment herein, the at least two nozzle heads are stationary or fixed, and wherein the at least two nozzle heads are configured to cover the entire width of the flatbed and wherein the at least two nozzle heads are configured to deposit the dye over the moving substrate.

According to an embodiment herein, one of the at least two nozzle heads is moved on a top side of the substrate while another of the at least two nozzle heads is moved on the bottom of the substrate, and wherein the at least two nozzle heads are configured to dye the substrate with a same color synchronously.

According to an embodiment herein, the system further comprises a micro controller device to calibrate the dye for the at least two nozzle heads by calculating a linear distance between the at least two nozzle heads and a time taken for the substrate to travel the distance between the two nozzle heads.

According to an embodiment herein, the loading mechanism further comprises a roller and stretch mechanism for stretching the substrate.

According to an embodiment herein, the substrate is stretched to at least 30% of maximum stretch during a dyeing process.

According to an embodiment herein, the substrate is any one of a knit, woven fabric or any material that absorbs the type of dye being deposited.

According to an embodiment herein, the color mixer is an analog device and wherein the color mixer has a tap to control a flow of ink, and wherein the color mixer is configured to mix and discharge only a selected color until the color is re-configured.

According to an embodiment herein, the color mixer is reset or reconfigured through the reset mechanism or manually.

According to an embodiment herein, the reset mechanism is a micro controller or a computing device configured to provide commands to the color mixer to mix a different set of CMYK and wherein the reset mechanism is further configured to control the at least two nozzle heads to dye the substrate till the mixed color is fully used up, and a saturation is reached, and wherein the reset mechanism is configured to control the at least two nozzle heads to start a new dye job or dyeing the substrate with a new color.

According to an embodiment herein, the operator console is configured to choose a color for dyeing, and wherein the operator console is configured to receive a shape to be dyed, and wherein the shape is any one of a geometric shape or any pattern.

According to an embodiment herein, the computing device is attached to the operator console to control, turn on/off of the nozzle heads and the moving head assembly to move and dye the substrate.

According to an embodiment herein, the roller mechanism is configured to rotate the fabric roll in a smooth motion so as to enable the at least two nozzle heads to dye different parts of the substrate.

According to an embodiment herein, the dye-print device typically consists of a nozzle or head for dyeing colors, a flat bed to keep the substrate, a roller mechanism to move the substrate and at least two printing nozzles on either side of the substrate. The nozzle is configured to move across the entire width of a substrate from one side to the other, while the substrate rolls to aid dyeing. The nozzle dyes a single color at any given time.

According to one embodiment herein, the substrate moves on a flatbed mechanism, while a nozzle deposits the dye on the substrate. According to an embodiment herein, the nozzle is configured to move the entire distance of the flatbed in both directions. The substrate is any one of a knit, woven fabric or any material that absorbs the type of dye being deposited.

According to an embodiment herein, the nozzle is controlled by a computing device such that the nozzle is moved in one or both directions over the flatbed. According to an embodiment herein, the nozzle is fixed and covers the entire width of the flatbed and deposits the dye over a moving substrate.

According to an embodiment herein, the nozzle is nothing more than a perforated tube that allows the ink to seep through to the moving substrate arranged below.

According to an embodiment herein, the nozzle is configured to move and the nozzle opening and the movement is switched on/off as it deposits a dye. This enables the device to dye a desired shape such as a square, circle or sleeve pattern on the substrate. According to an embodiment herein, the dye-print machine can only use a single color at any given time. So, although it can dye a specific shape or area, it still cannot print a photo or multi-color pattern, for example, unlike a digital printer.

According to an embodiment herein, the system comprises a flat bed for laying the substrate, a roller mechanism for the undyed fabric roll to be loaded, a moving head assembly for the nozzle to move in at least one direction through the entire length of the flatbed, an ink feeder mechanism, ink containers and an operator console.

According to an embodiment herein, two print heads are used to dye the fabric. One head/nozzle is operated/moved on top side of the substrate while another head/nozzle is operated/moved on the bottom side of the substrate, thereby enabling both the heads to dye the same color synchronously. According to an embodiment herein, both the heads are used/operated/moved asynchronously. A micro controller device is provided to calibrate the dye for the two heads/nozzles by calculating a linear distance between the two and a time taken for the fabric roll to travel the distance between the two.

According to an embodiment herein, the composite color is dynamically mixed as a process color from a ink containers, that at least includes C, M, Y, K (Cyan, Magenta, Yellow & Black). The inks for C, M, Y, K (Cyan, Magenta, Yellow and Black) are mixed before being deposited through the nozzle. According to an embodiment herein, the color mixer is an analog device and a tap is used to control the flow of ink. When the color mixer is configured once, then the color mixer is configured to mix only that color till the color mixer is re-configured manually.

According to an embodiment herein, a dye print device needs to be instructed to switch/change color using a "reset" mechanism. According to an embodiment herein, the reset mechanism is configured to instruct the color mixer to mix a different set of CMYK, instruct the nozzle to dye the substrate till the old color is fully used up, dyeing a swatch with the new color till saturation is reached and then start the new dye job.

According to an embodiment herein, water-based dyes are easily used which are less toxic and more environmentally friendly. The device itself is manufactured/built economically because the device uses only one color at a time.

According to an embodiment herein, the system comprises a flat bed for laying the fabric, a roller mechanism for the undyed fabric roll to be loaded, a moving head assembly for the nozzle to move in at least one direction through the entire length of the flatbed, an ink feeder mechanism, nozzle and an operator console. Using the operator console, the color for dyeing is chosen. According to an embodiment herein, a shape to be dyed is input as well. The shape includes but not limited to rectangle, circle, triangle, any geometric shape, sleeve pattern, etc. A computing device is attached to the console to control the nozzle to turn it on/off and the moving head assembly to move and dye the fabric. The roller rotates the fabric roll in a smooth motion so as to enable the nozzle to dye different areas of the fabric.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

Additional aspects, advantages, features and objects of the present disclosure would be made apparent from the drawings and the detailed description of the illustrative embodiments construed in conjunction with the appended claims that follow. The systems and methods illustrated are equally applicable to virtually any communication device, including, but not limited to, computers and mobile phones.

It will be appreciated that features of the present disclosure are susceptible to being combined in various combinations without departing from the scope of the present disclosure as defined by the appended claims. Additional aspects, advantages, features and objects of the present disclosure would be made apparent from the drawings and the detailed description of the illustrative embodiments construed in conjunction with the appended claims that follow.

BRIEF DESCRIPTION OF THE DRAWINGS

For the purpose of illustrating the present disclosure, exemplary constructions of the disclosure are shown in the drawings. However, the present disclosure is not limited to specific methods and instrumentalities disclosed herein. Moreover, those in the art will understand that the drawings are not to scale. Wherever possible, like elements have been indicated by identical numbers.

The other objects, features and advantages will occur to those skilled in the art from the following description of the preferred embodiment and the accompanying drawings in which.

Figure 1:
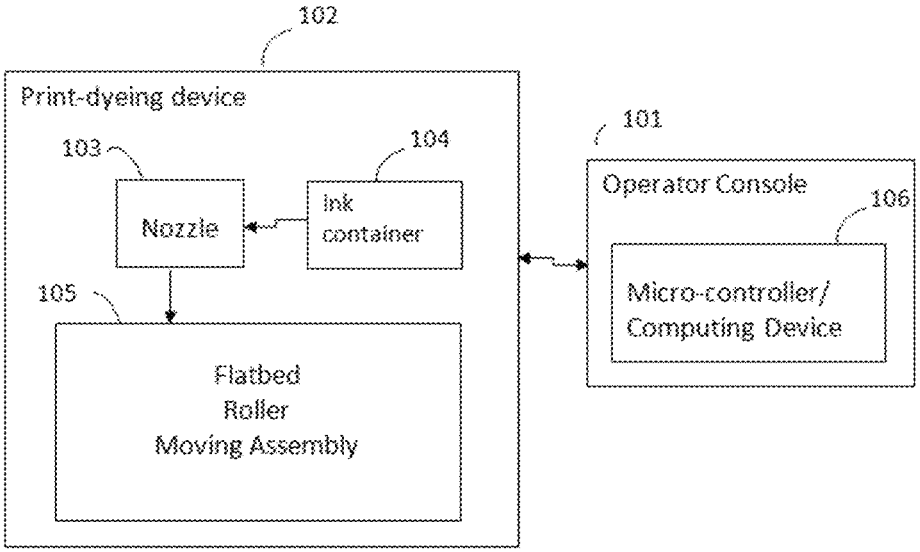
FIG. 1 illustrates a block diagram of a dye print device, according to an embodiment herein.

Although the specific features of the present invention are shown in some drawings and not in others. This is done for convenience only as each feature may be combined with any or all of the other features in accordance with the present invention.

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION OF THE EMBODIMENTS HEREIN

The detailed description of various exemplary embodiments of the present invention is described herein with reference to the accompanying drawings. It should be noted that the embodiments are described herein in such details as to clearly communicate the present invention. However, the amount of details provided herein is not intended to limit the anticipated variations of embodiments; on the contrary, the intention is to cover all modifications, equivalents, and alternatives falling within the spirit and scope of the present invention as defined by the appended claims.

It is also to be understood that various arrangements may be devised that, although not explicitly described or shown herein, embody the principles of the present invention. Moreover, all statements herein reciting principles, aspects, and embodiments of the present invention, as well as specific examples, are intended to encompass equivalents thereof.

While the embodiments of this susceptible to various modifications and alternative forms, specific embodiment thereof has been shown by way of example in the drawings and will be described in detail below. It should be understood, however that it is not intended to limit the present invention to the forms disclosed, but on the contrary, the present invention is to cover all modifications, equivalents, and alternatives falling within the scope of the present invention.

The terminology used herein is for the purpose of describing particular embodiments only and is not intended to be limiting of example embodiments. As used herein, the singular forms "a", "an" and "the" are intended to include the plural forms as well, unless the context clearly indicates otherwise. It will be further understood that the terms "comprises", "comprising", "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

The following description of the presently contemplated best mode of practicing the disclosure is not to be taken in a limiting sense, but is made merely for the purpose of describing the general principles of the disclosure. Embodiments of the present disclosure present technological improvements as solutions to one or more of the above-mentioned technical problems recognized by the inventor in conventional systems. The following detailed description illustrates embodiments of the present disclosure and ways in which they may be implemented. Although some modes of carrying out the present disclosure have been disclosed, those skilled in the art would recognize that other embodiments for carrying out or practicing the present disclosure are also possible.

The various embodiments of the invention provide a novel device and technique for dyeing localized areas of a fabric, in small quantities and when needed (on-demand) This technique is referred herein using the moniker "Dye Print". According to an embodiment herein, the device is a special type of printer that only deposits one-color at a time (unlike a typical digital printer which can print millions of color, as tiny dots). Unlike a digital printer, the dye-print machine disclosed in the embodiments herein uses a pre-mixer to create a composite color, which is then deposited on to a substrate. The dye-print machine deposits only a single color at any given time.

According to an embodiment herein, a system for dyeing fabrics on-demand, comprises a flatbed mechanism for loading a substrate for dyeing; an ink feeder mechanism, consisting of at least Cyan, Magenta, Yellow and Black (C, M, Y, K) colors and a color combiner mechanism or color mixer to combine the inks and create a composite ink; at least two nozzle heads to deposit the composite ink on both sides of a substrate; an operator console; and a reset mechanism.

According to an embodiment herein, the at least two nozzle heads are configured to dye the substrate through a synchronous ink deposition technique.

According to an embodiment herein, the at least two nozzle heads are configured to dye the substrate through an asynchronous ink deposition technique.

According to an embodiment herein, the at least two nozzle heads are mounted on a moving head assembly to traverse the entire width of the substrate and the nozzle is further turned on or off.

According to an embodiment herein, the at least two nozzle heads are configured to move through the entire distance of the flatbed in both directions.

According to an embodiment herein, the at least two nozzle heads are controlled by a computing device such that both the nozzles are moved in one or both directions over the flatbed.

According to an embodiment herein, the at least two nozzle heads are stationary or fixed, and wherein the at least two nozzle heads are configured to cover the entire width of the flatbed and wherein the at least two nozzle heads are configured to deposit the dye over the moving substrate.

According to an embodiment herein, one of the at least two nozzle heads is moved on a top side of the substrate while another of the at least two nozzle heads is moved on the bottom of the substrate, and wherein the at least two nozzle heads are configured to dye the substrate with a same color synchronously.

According to an embodiment herein, the system further comprises a micro controller device to calibrate the dye for the at least two nozzle heads by calculating a linear distance between the two nozzle heads and a time taken for the substrate to travel the distance between the two nozzle heads.

According to an embodiment herein, the loading mechanism further comprises a roller and stretch mechanism for stretching the substrate.

According to an embodiment herein, the substrate is stretched to at least 30% of maximum stretch during a dyeing process.

According to an embodiment herein, the substrate is any one of a knit, woven fabric or any material that absorbs the type of dye being deposited.

According to an embodiment herein, the color mixer is an analog device and wherein the color mixer has a tap to control a flow of ink, and wherein the color mixer is configured to mix and discharge only a selected color until the color is re-configured.

According to an embodiment herein, the color mixer is reset or reconfigured through the reset mechanism or manually.

According to an embodiment herein, the reset mechanism is a micro controller or a computing device configured to provide commands to the color mixer to mix a different set of CMYK and wherein the reset mechanism is configured to control the at least two nozzle heads to dye the substrate till the last mixed color is fully used up, and a saturation is reached for the new color, and wherein the reset mechanism is configured to control the at least two nozzle heads to start a new dye job or dyeing the substrate with a new color.

According to an embodiment herein, the operator console is configured to choose a color for dyeing, and wherein the operator console is configured to receive a shape to be dyed, and wherein the shape is any one of a geometric shape such as rectangular, circle, triangle or sleeve pattern.

According to an embodiment herein, the computing device is attached to the operator console to control and to turn on/off the at least two nozzle heads and the moving head assembly to move and dye the substrate.

According to an embodiment herein, the roller mechanism is configured to rotate the fabric roll in a smooth motion so as to enable the at least two nozzle heads to dye different areas of the substrate.

According to an embodiment herein, the dye-print device typically consists of a nozzle or head for dyeing colors, a flat bed to keep the substrate, a roller mechanism to move the substrate and at least two printing nozzles on either side of the substrate. The nozzle is configured to move across the entire width of a substrate from one side to the other, while the substrate rolls to aid dyeing. The nozzle dyes a single color at any given time.

According to one embodiment herein, the substrate moves on a flatbed mechanism, while a nozzle deposits the dye on the substrate. According to an embodiment herein, the nozzle is configured to move the entire distance of the flatbed in both directions. The substrate is any one of a knit, woven fabric or any material that absorbs the type of dye being deposited.

According to an embodiment herein, the nozzle is controlled by a computing device such that the nozzle is moved in one or both directions over the flatbed. According to an embodiment herein, the nozzle is fixed and covers the entire width of the flatbed and deposits the dye over a moving substrate.

According to an embodiment herein, the nozzle is nothing more than a perforated tube that allows the ink to seep through to the moving substrate arranged below.

According to an embodiment herein, the nozzle is configured to move and the nozzle opening and the movement is turned/switched on/off as it deposits a dye. This enables the device to dye a desired shape such as a square, circle or sleeve pattern on the substrate According to an embodiment herein, the dye-print machine can only use a single color at any given time. So, although it can dye a specific shape or area, it still cannot print a photo or multi-color pattern, for example, unlike a digital printer.

According to an embodiment herein, the system comprises a flat bed for laying the substrate, a roller mechanism for the undyed fabric roll to be loaded, a moving head assembly for the nozzle to move in at least one direction through the entire length of the flatbed, an ink feeder mechanism, ink containers and an operator console.

According to an embodiment herein, two print heads are used to dye the fabric. One head/nozzle is operated/moved on top side of the substrate while another head/nozzle is operated/moved on the bottom side of the substrate, thereby enabling both the heads to dye the same color synchronously. According to an embodiment herein, both the heads are used/operated/moved asynchronously. A micro controller device is provided to calibrate the dye for the two heads/nozzles by calculating a linear distance between the two and a time taken for the fabric roll to travel the distance between the two.

According to an embodiment herein, the composite color is dynamically mixed as a process color from ink containers, that at least includes C, M, Y, K (Cyan, Magenta, Yellow & Black). The inks for C, M, Y, K (Cyan, Magenta, Yellow and Black) are mixed before being deposited through the nozzle. According to an embodiment herein, the color mixer is an analog device and a tap is used to control the flow of ink. When the color mixer is configured once, then the color mixer is configured to mix only that color till the color mixer is re-configured manually.

According to an embodiment herein, a dye print device needs to be instructed to switch/change color using a "reset" mechanism. According to an embodiment herein, the reset mechanism is configured to instruct the color mixer to mix a different set of CMYK, then instruct the nozzle to dye the substrate till the old color is fully used up, dyeing a swatch with the new color till saturation is reached and then start the new dye job.

According to an embodiment herein, water-based dyes are easily used which are less toxic and more environmental friendly. The device itself is manufactured/built economically because the device uses only one color at a time.

According to an embodiment herein, the system comprises a flat bed for laying the fabric, a roller mechanism for the undyed fabric roll to be loaded, a moving head assembly for the nozzle to move in at least one direction through the entire length of the flatbed, a ink feeder mechanism, nozzle and an operator console. Using the operator console, the color for dyeing is chosen. According to an embodiment herein, a shape to be dyed is input as well. The shape includes but is not limited to rectangle, circle, triangle, sleeve pattern, etc. A computing device is attached to the console to control the nozzle to turn it on/off and the moving head assembly to move and dye the fabric. The roller rotates the fabric roll in a smooth motion so as to enable the nozzle to dye different parts of the fabric.

Figure 2:
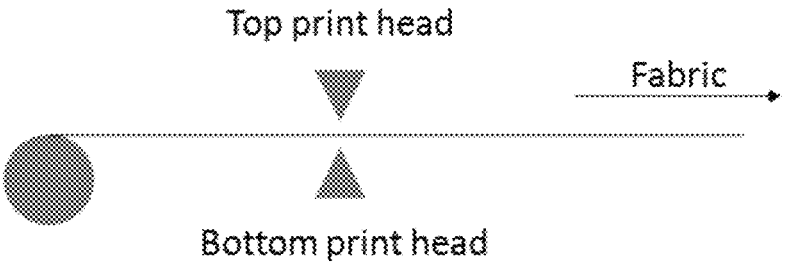
FIG. 2 illustrates schematic representation of roller heads above and below the substrate in a dye print device, according to an embodiment herein.
Figure 3:
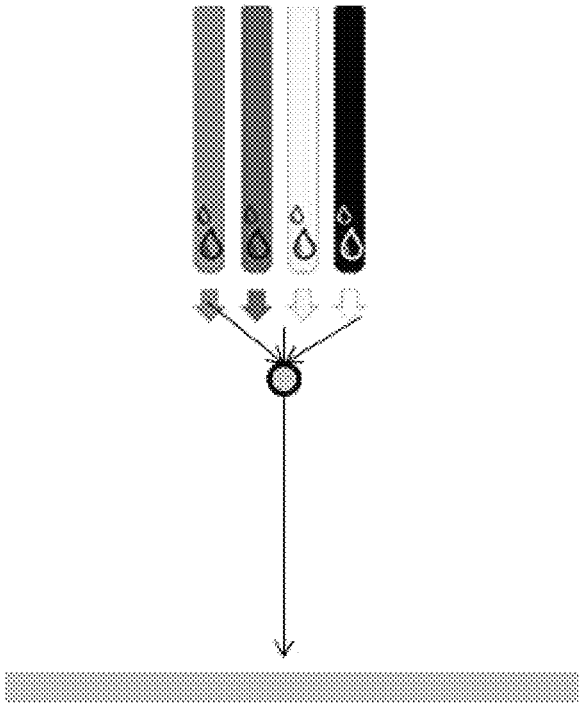
FIG. 3 illustrates schematic representation of inks being pre-mixed to create a composite color, which is then deposited on to a substrate, according to an embodiment herein.

FIG. 1 illustrates a block diagram of a dye print device, according to an embodiment herein; while FIG. 2 illustrates schematic representation of roller heads over the substrate in a dye print device, according to an embodiment herein. With respect to FIG. 1 and FIG. 2, the system comprises a flat bed for laying the substrate, a roller mechanism for the undyed fabric roll to be loaded, a moving head assembly for the nozzle to move in at least one direction through the entire length of the flatbed, a ink feeder mechanism, ink containers and an operator console. FIG. 3 illustrates schematic representation of inks being pre-mixed to create a composite color, which is then deposited on to a substrate, according to an embodiment herein.

According to an embodiment herein, two print heads are used to dye the fabric. One head/nozzle is operated/moved on top side of the substrate while another head/nozzle is operated/moved on the bottom side of the substrate, thereby enabling both the heads to dye the same color synchronously. According to an embodiment herein, both the heads are used/operated/moved asynchronously. A micro controller device is provided to calibrate the dye for the two heads/nozzles by calculating a linear distance between the two and a time taken for the fabric roll to travel the distance between the two.

According to an embodiment herein, the composite color is dynamically mixed as a process color from ink containers, that at least includes C, M, Y, K (Cyan, Magenta, Yellow & Black). The inks for C, M, Y, K (Cyan, Magenta, Yellow and Black) are mixed before being deposited through the nozzle. According to an embodiment herein, the color mixer is an analog device and a tap is used to control the flow of ink. When the color mixer is configured once, then the color mixer is configured to mix only that color till the color mixer is re-configured manually.

According to an embodiment herein, a dye print device needs to be instructed to switch/change color using a "reset" mechanism. According to an embodiment herein, the reset mechanism is configured to instruct the color mixer to mix a different set of CMYK, then instruct the nozzle to dye the substrate till the old color is fully used up, dyeing a swatch with the new color till saturation is reached and then start the new dye job.

According to an embodiment herein, water-based dyes are easily used which are less toxic and more environmentally friendly. The device itself is manufactured/built economically because the device uses only one color at a time.

According to an embodiment herein, the system comprises a flat bed for laying the fabric, a roller mechanism for the undyed fabric roll to be loaded, a moving head assembly for the nozzle to move in at least one direction through the entire length of the flatbed, an ink feeder mechanism, nozzle and an operator console. Using the operator console, the color for dyeing is chosen. According to an embodiment herein, a shape to be dyed is input as well. The shape includes but not limited to rectangle, sleeve shape, etc. A computing device is attached to the console to control the nozzle to turn it on/off and the moving head assembly to move and dye the fabric. The roller rotates the fabric roll in a smooth motion so as to enable the nozzle to dye different parts of the fabric.

The description, embodiments and figures are not to be taken as limiting the scope of the claims. It should also be understood that throughout this disclosure, unless logically required to be otherwise, where a process or method is shown or described, the steps of the method may be performed in any order, repetitively, iteratively or simultaneously. At least portions of the functionalities or processes described herein may be implemented in suitable computer-executable instructions. It will be appreciated that features of the present disclosure are susceptible to being combined in various combinations and additional features may be introduced without departing from the scope of the present disclosure.

While the foregoing describes various embodiments of the present invention, other and further embodiments of the present invention may be devised without departing from the basic scope thereof. The scope of the invention is determined by the claims that follow. The present invention is not limited to the described embodiments, versions or examples, which are included to enable a person having ordinary skill in the art to make and use the present invention when combined with information and knowledge available to the person having ordinary skill in the art.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments.

It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope.

Although the embodiments herein are described with various specific embodiments, it will be obvious for a person skilled in the art to practice the embodiments herein with modifications.

What is claimed is:

1. A system for dyeing fabrics on-demand, comprising:

A flatbed mechanism for loading a substrate for dyeing;

an ink feeder mechanism, comprising at least Cyan, Magenta, Yellow and Black (C, M, Y, K) colors and a color combiner or color mixer mechanism to combine the inks and create a composite ink;

at least two nozzle heads to deposit the composite ink on both sides of a substrate;

an operator console; and a reset mechanism.

2. The system of claim 1, wherein the at least two nozzle heads are configured to dye the substrate through a synchronous ink deposition technique.

3. The system of claim 1, wherein the at least two nozzle heads are configured to dye the substrate through an asynchronous ink deposition technique.

4. The system of claim 1, wherein the at least two nozzle heads are mounted on a moving head assembly to traverse an entire width of the substrate and the nozzle is further turned on or off.

5. The system of claim 1, wherein the at least two nozzle heads are configured to move through an entire width of the flatbed in both directions.

6. The system of claim 1, wherein the at least two nozzle heads are controlled by a computing device such that both the nozzles are moved in one or both directions over the flatbed.

7. The system of claim 1, wherein the at least two nozzle heads are stationary or fixed, and wherein the at least two nozzle heads are configured to cover the entire width of the flatbed and wherein the at least two nozzle heads are configured to deposit the dye over the substrate.

8. The system of claim 1, wherein one of the at least two nozzle heads is moved on the top side of the substrate while another of the at least two nozzle heads is moved on the bottom side of the substrate, and wherein the at least two nozzle heads are configured to dye the substrate with a same color synchronously.

9. The system of claim 1 further comprising a micro controller device to calibrate the dye for the at least two nozzle heads by calculating a linear distance between the at least two nozzle heads and a time taken for the substrate to travel a distance between the at least two nozzle heads.

10. The system of claim 1, wherein the loading mechanism further comprises a roller and stretch mechanism for stretching the substrate.

11. The system of claim 1, wherein the substrate is stretched to at least 30% of maximum stretch during a dyeing process.

12. The system of claim 1, wherein the substrate is any one of a knit, woven fabric or any material that absorbs the type of dye being deposited.

13. The system of claim 1, wherein the color mixer is an analog device and wherein the color mixer has a tap to control a flow of ink, and wherein the color mixer is configured to mix and discharge only a selected color until the color is re-configured.

14. The system of claim 1, wherein the color mixer is reset or reconfigured through the reset mechanism or manually.

15. The system of claim 1, wherein the reset mechanism is a micro controller or a computing device configured to provide commands to the color mixer to mix a different set of CMYK and wherein the reset mechanism is configured to control the at least two nozzle heads to dye the substrate till the last mixed color is fully used up, and a saturation for the new color is reached, and wherein the reset mechanism is configured to control the at least two nozzle heads to start a new dye job or dyeing the substrate with a new color.

16. The system of claim 1, wherein the operator console is configured to choose a color for dyeing, and wherein the operator console is configured to receive a shape to be dyed, and wherein the shape is any one of a geometric shape.

17. The system of claim 1, wherein a micro-controller or computing device is attached to the operator console to turn on/off the at least two nozzle heads and to controls the moving head assembly to move and dye the substrate.

18. The system of claim 1, wherein the roller mechanism is configured to rotate the fabric roll in a smooth motion so as to enable the at least two nozzle heads to dye different parts of the substrate.

* * * * *